United States Patent [19]

Jansen

[11] 4,301,840

[45] Nov. 24, 1981

[54] FIXED TURRET SUBSEA HYDROCARBON PRODUCTION TERMINAL

[75] Inventor: Martin B. Jansen, Agoura, Calif.

[73] Assignee: Amtel, Inc., Providence, R.I.

[21] Appl. No.: 49,960

[22] Filed: Jun. 18, 1979

[51] Int. Cl.[3] ..... B65B 3/04; F16L 39/04

[52] U.S. Cl. ..... 141/98; 137/615; 141/284; 141/387

[58] Field of Search ..... 9/8 P; 137/606, 615; 141/279, 284, 387, 388, 981; 166/91; 285/119; 405/195, 164

[56] References Cited

U.S. PATENT DOCUMENTS 2,316,383 4/1943 Abercrombie ..... 166/91

4,090,538 5/1978 Kotcharian ..... 141/387 X

*Primary Examiner*—Frederick R. Schmidt

*Attorney, Agent, or Firm*—Freilich, Hornbaker, Wasserman, Rosen & Fernandez

[57] ABSTRACT

An offshore oil production terminal system is described which includes a transfer structure having a nonrotatable turret anchored to the sea floor and a rotatable portion fixed to a dedicated storage vessel, and also a fluid conduit extending from the seabed up through the turret to a fluid swivel and from the rotatable portion of the fluid swivel to the vessel, which facilitates use of a moderate cost fluid swivel. A choke located on the nonrotatable turret, decreases the high pressure of oil from the seabed (e.g. 2000 psi) to a moderate pressure (e.g. 200 psi) for passage through the fluid swivel, so that a moderate pressure fluid swivel can be utilized. The turret has a control deck at the same level as the vessel deck, to facilitate entry of personnel to operate controls directly connected to valves at the seabed without requiring rotational joints between the controls and the devices they operate. Power to produce pressured hydraulic fluid for controlling valves and the like, is obtained by flowing moderate pressure air (e.g. 200 psi) through a fluid swivel on top of the turret to an air-motor-hydraulic pump combination on the fixed turret, to produce high pressure hydraulic fluid (e.g. 3000 psi) for control system operation.

13 Claims, 4 Drawing Figures

106
104
39
42
10
55
52
50
105
48
24
14
32
12
30
26
28
28'
35
37
40
34
36
20
80
22
82
16
18
18
38

FIXED TURRET SUBSEA HYDROCARBON PRODUCTION TERMINAL

BACKGROUND OF THE INVENTION

Hydrocarbons such as oil from large offshore fields can be produced by large and extremely costly production platforms that include massive rigid structures fixed to the seabed and extending up to the sea surface. However, such platforms are too costly for use in the exploitation of small offshore oil fields, and in early production systems wherein it is desirable to produce oil from large fields during the period of perhaps a few years required for the building and installation of a massive production platform. A relatively low cost production system with a short lead time can be provided by utilizing a dedicated storage vessel and a transfer structure which can be connected to one end of the vessel and moored to the sea floor as by catenary chains, and which can be utilized with fluid conduits that extend from the sea floor through the transfer structure to the vessel. Such a transfer structure can include a relatively stationary portion connected through the chains to the sea floor, and a rotatable portion which is connected to the vessel to permit the vessel to rotate without limit about the stationary portion under the influence of currents, winds, and waves. It may be noted that such a stationary transfer structure portion can move, but is restrained against movement without limit, while the vessel is able to rotate without limit about a vertical axis about the stationary structure portion.

One disadvantage in using a vessel which can drift about the transfer structure, is that rotatable connections must be made between the rotatable vessel and stationary hoses or other lines that extend down to the sea floor. One rotatable joint is a fluid swivel for carrying oil from undersea wells to the vessel. However, such wells typically produce oil at high pressures such as thousands of psi, while moderate cost fluid swivels designed to carry pumped oil normally operate at pressures of only up to a few hundred psi. Since fluid swivels are costly and high maintenance items, the cost and maintenance of the production system would be greatly increased if very high pressure fluid swivels had to be utilized to carry oil from a plurality of subsea oil wells to the vessel.

The rotational movement of the vessel relative to the fixed turret of the transfer structure, can also complicate controls for the system. A typical control arrangement utilizes several high pressure hydraulic fluid lines to operate various underwater valves and the like, with the hydraulic lines carrying pressures of perhaps a few thousand psi. While it is possible to utilize a shipboard power station and hydraulic pump and control assembly to create hydraulic control signals at thousands of psi, and to pass such signals through several fluid swivels to the stationary turret of the transfer structure, the required fluid swivel would be costly. A mooring and cargo transfer system for the transfer of fluid cargo and other fluids between a relatively stationary transfer structure portion and a rotatable vessel, which minimized the problems that can arise from rotation of the vessel, would facilitate the construction of moderate cost production systems as well as other dedicated vessel mooring systems.

SUMMARY OF THE INVENTION

In accordance with one embodiment of the present invention, an offshore hydrocarbon production terminal installation is provided which facilitates the transfer of oil or other hydrocarbons from an undersea oil well to a rotatable vessel, and which also facilitates the control of stationary underwater valves and the like by personnel normally quartered on the rotatable vessel. The installation includes one or more fluid conduits extending up from the sea floor through a transfer structure, and through a fluid swivel thereon to the vessel. A choke on the fixed turret of the transfer structure is connected in series with the conduit, to reduce the pressure of fluid received from the sea floor so that the fluid swivel carries fluid at only a moderate pressure. This permits, for example, oil at thousands of psi received from an offshore oil well, to be passed through a swivel unit that is constructed to carry oil at a pressure of only a few hundred psi. Where a plurality of fluid conduits are used to carry oil from a plurality of different wells at the sea floor, chokes connected to the different conduits enable the fluids to be commingled in a manifold prior to passage through the fluid swivel.

Hydraulic control lines that carry control signals at high pressures such as thousands of psi to control underwater valves and the like, receive pressured hydraulic fluid from a source located on the fixed turret of the transfer structure. The high pressure source, such as a pump which delivers hydraulic fluid at thousands of psi, is powered by a power fluid such as pressured air which is delivered at a moderate pressure such as a few hundred psi through a swivel unit that connects an air pump on the vessel to an air motor on the fixed turret that powers the hydraulic pump.

A control panel containing various controls is located on an upper control deck of the fixed turret. The turret control deck is circular and located adjacent to and at approximately the same level as the deck of the ship or an extension thereof, so that personnel normally quartered on the vessel can easily walk onto the control deck to operate the controls. This permits the use of a control panel which is fixed with respect to the hydraulic control lines and the like that connect the control panel to fixed valves and other remotely operated devices.

The novel features of the invention are set forth with particularity in the appended claims. The invention will be best understood from the following description when read in conjunction with the accompanying drawings.

DESCRIPTION OF THE PREFERRED EMBODIMENT

Figure 1:
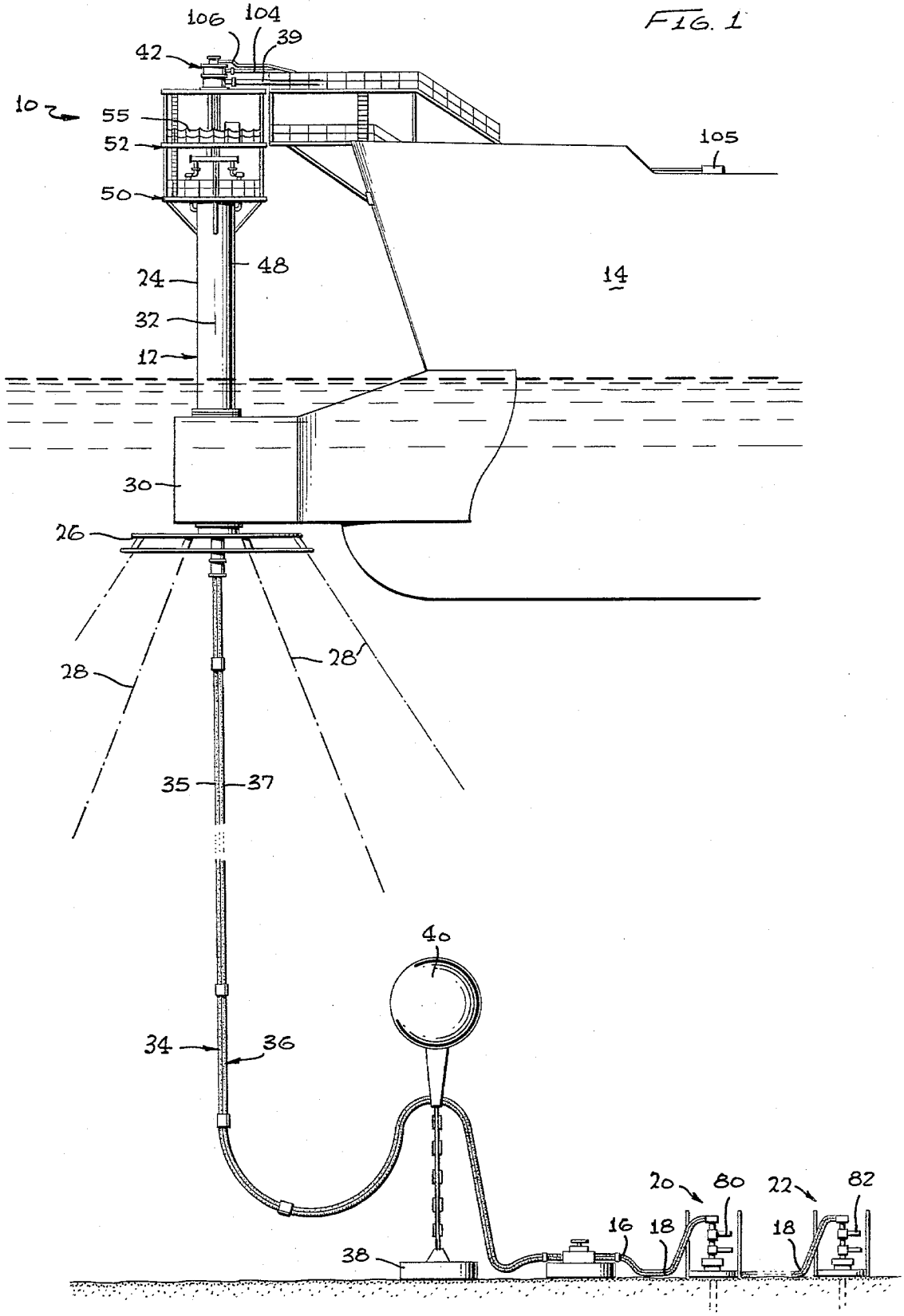
FIG. 1 is a partial side elevation view of a mooring system constructed in accordance with the present invention.
Figure 2:
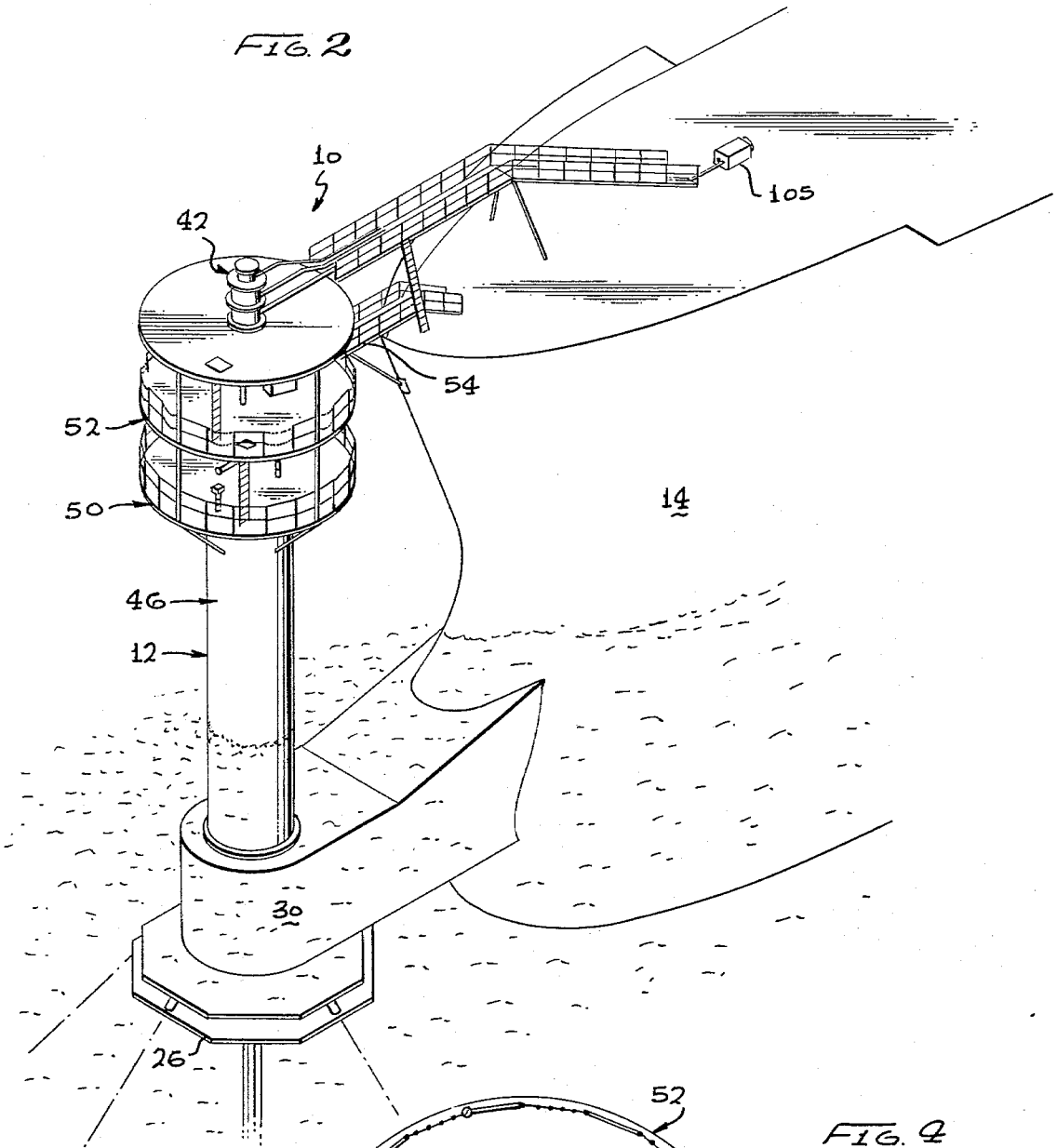
FIG. 2 is a partial perspective view of the system of FIG. 1.

FIG. 1 illustrates a fixed turret mooring system 10 of the present invention, which includes a negatively buoyant transfer structure 12 located substantially at the sea surface, for holding a floating storage vessel 14 and transferring a fluid cargo such as oil to the vessel. The oil is received from undersea pipelines 16, 18 connected to undersea oil wells 20, 22. The transfer structure 12 has a substantially nonrotatable frame 24 with a mooring chain table 26 at the bottom which is anchored by catenary chains 28 to the seabed, and has a rotatable frame 30 which is fixed to the vessel 14. This permits the vessel 14 to rotate without limit about the vertical axis 32 of the transfer structure under the influence of currents, waves, and wind, and yet the transfer structure anchors the vessel in an approximate location near the pipelines 16, 18. It may be noted that in referring to the frame 24 or a portion thereof as nonrotatable, or stationary, or fixed, it is meant that the frame cannot rotate without limit about a vertical axis. The frame 24 can pivot by a limited amount about the vertical axis, as well as tilt and shift position by a limited amount.

Oil from the pipeline 16, 18 passes through fluid conduits 34, 36 that include lower portions held over a sea floor base 38 by a support buoy 40. Each conduit includes a stationary riser portion 35, 37 that extends up to the transfer structure and vertically therealong to a swivel unit 42 at the top of the transfer structure. A pipe 39 which rotates with the vessel and which extends from the swivel unit 42 to the vessel 14 to deliver the oil to the vessel, serves as a portion of both conduits 34, 36. The term pipe refers to a conduit, and includes flexible conduits or hoses as well as rigid ones.

The use of a transfer structure 12 lying close to a storage vessel 14, and with the vessel movable substantially only in rotation about a vertical axis 32 with respect to the stationary portion of the transfer structure and to the fluid conduit or pipe portions that extend down to the sea floor, can result in a relatively simple and economical system. However, this system may still have considerable complexity, especially where it is utilized to produce oil from undersea wells. One of the problems encountered is that oil received from the wells such as 20, 22 may be at relatively high pressures such as thousands of psi, and in fact oil from different wells may be received at different pressures. Swivel units such as 42 of proven reliability are available for transferring fluids at pressures of a few hundred psi, which is a typical pressure range at which fluid may be pumped by pumps through lines. However, even these proven swivel units are of considerable cost and require considerable maintenance, so that it would be expected that swivel units which had to withstand pressures of thousands of psi would be considerably more expensive in construction and maintenance.

Another problem encountered in such systems, is that production installations normally require numerous remote controls, such as various valves at the sea floor, which can be best operated by hydraulic lines extending to the sea floor. Such hydraulic lines are typically operated at pressures of a few thousand psi. If such pressured hydraulic fluid had to be generated on board the vessel 14, another fluid swivel would be required to carry the hydraulic fluid, and such a fluid swivel carrying hydraulic fluid at thousands of psi would also be costly. In addition, the operation of a production installation requires the operation of numerous valves at the sea base, but by personnel normally quartered on the vessel 14. Thus, a large potential source of problem in the design of the vessel 14 with respect to the fixed (i.e. substantially nonrotatable about a vertical axis) portion of the transfer structure and the fixed undersea pipelines and wells.

Figure 3:
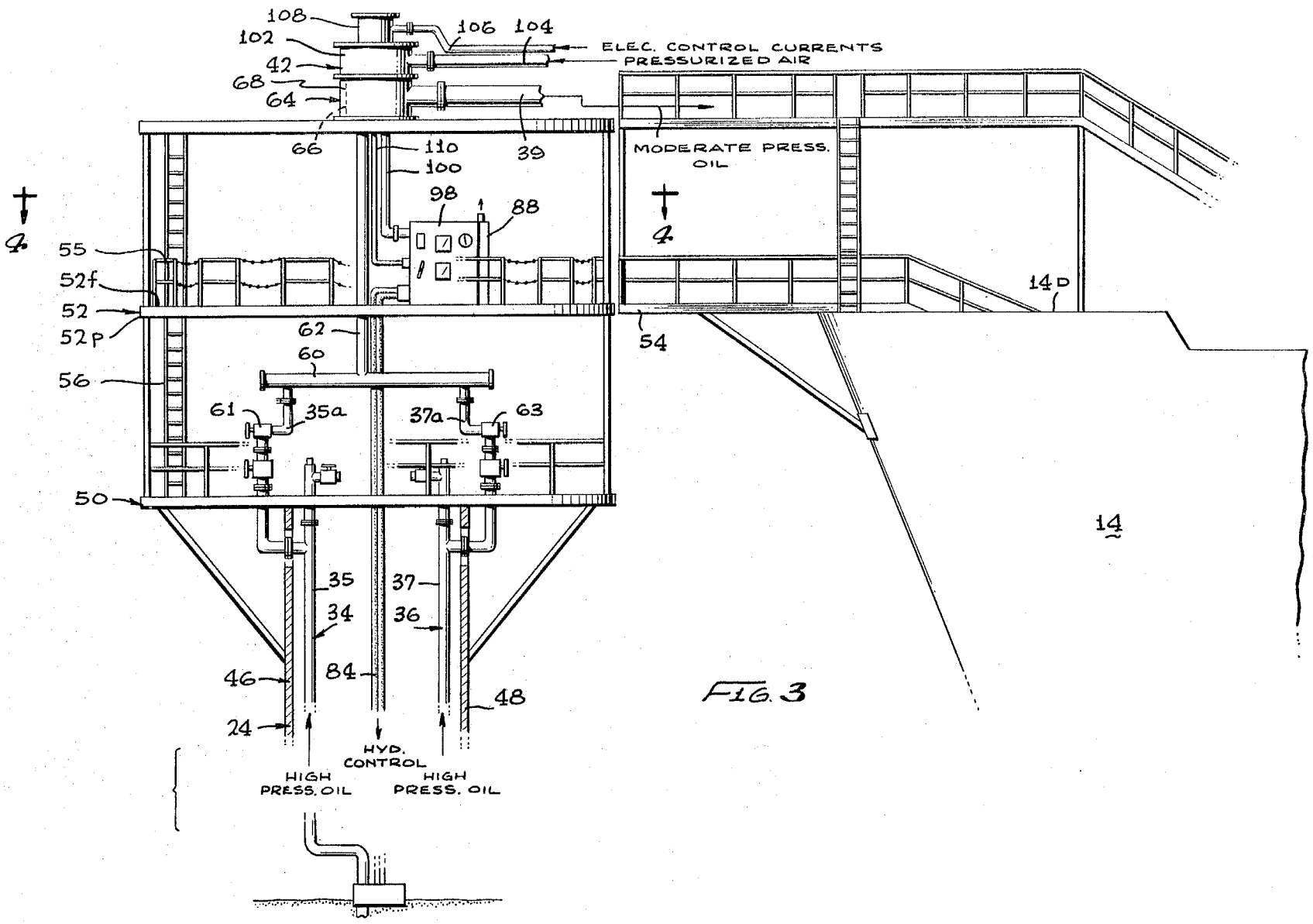
FIG. 3 is a partial sectional view of the system of FIG. 1.

FIG. 3 illustrates some of the details of the installation of FIG. 1. The fixed portion 24 of the transfer structure includes a turret 46 having a hollow vertical enclosure 48 and a pair of decks 50, 52 at the top. A lowermost one of the decks 50 may be considered a manifold deck which includes various pipe and valve arrangements that require occasional operation, while the uppermost deck 52 may be considered a control center deck which requires more regular attention from personnel. The swivel unit 42 is a multiple product swivel unit, which lies above the upper deck 52, at the top of the turret. The floor of the upper deck 52 is located at substantially the same level as the deck 14D of the vessel, and of an extension 54 thereof which may be considered part of the vessel deck, to facilitate the passage of personnel normally quartered on the vessel 14, who can walk along the walkway 54 and then step directly onto the floor **52*f* of the upper deck 52. The upper deck floor has a circular periphery 52*p*, so that even though the vessel 14 may rotate to any position about the relatively stationary upper deck 52, personnel can always step from the walkway 54 onto the deck floor without crossing a wide gap. A fence 55 with multiple entrances is provided about the upper deck, as by providing multiple posts and chains strung between them that can be temporarily detached. Access to the lower deck 50 can be provided as by way of a ladder 56**.

The two riser portions 35, 37 of the fluid conduits include portions **35*a*, 37*a* which extend above the deck 50 to a manifold 60. Each conduit connects to a choke 61 or 63 which serves as a pressure reducing means to reduce the high pressure in the riser portion such as 35 of a conduit to a portion above the choke. The chokes, which may be considered portions of the fluid conduits, serve to enable the combining of high pressure oil from a plurality of wells into a single line, and also serve to greatly reduce the pressure of the flowing oil. For example, the lower portion or riser 35 of the conduit 34 may initially receive oil from the corresponding well at a pressure such as 2000 psi. The lower portion or riser 37 of the other conduit 36 may receive oil at a somewhat different pressure such as 3000 psi. So long as the pressure in the commingling manifold 60** is maintained at less than 2000 psi, fluid from both wells can flow into it.

The chokes 61, 63 are adjusted so that a moderate pressure of only a few hundred psi is maintained in the manifold 60 and in a line 62, leading downstream from the choke to the swivel unit. This enables a fluid swivel 42 to be utilized which is capable of carrying fluid at only a moderate pressure such as a few hundred psi. The fluid swivel 42 includes a cargo-carrying portion 64, which may be considered part of the fluid conduits, and which has a nonrotatable part 66 that is connected to the pipe 62 and a rotatable part 68 that is connected to the rotatable pipe 39 that rotates with the vessel 14. It may be noted that the pipes 62 and 39 serve as portions of both fluid conduits 34, 36 which extend from the sea bed to the vessel. The pressure of perhaps 200 psi of oil flowing through the fluid swivel portion 64 is adequate to flow oil at a high rate to the vessel, and yet is small enough to permit the use of a fluid swivel portion 64 which is capable of withstanding pressures of only a few hundred psi. Thus, by reducing the high pressure of oil on a nonrotatable portion of the transfer structure, the oil can be transferred to the rotating vessel by the use of a fluid swivel which must withstand only a moderate pressure instead of the high pressure of oil found at the well head.

Figure 4:
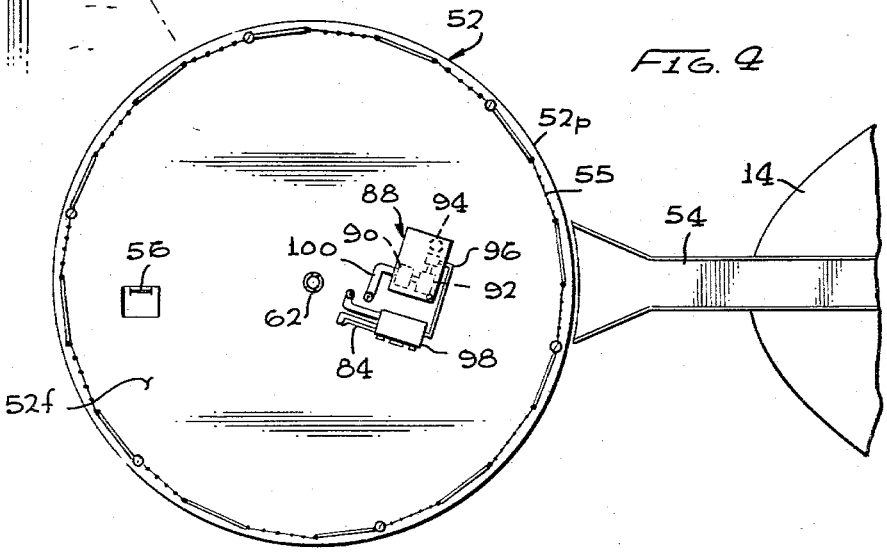
FIG. 4 is a view taken on the line 4—4 of FIG. 3.

A production installation normally requires many remotely operated valves. For example, FIG. 1 shows a pair of well head valves 80, 82 that permit the shut off of oil from the wells. Typical installations utilize a number of remotely operated valves, including a valve lying under the seabed surface to close the well in case of damage to the above seabed installation that would otherwise permit flow of oil into the surrounding sea to pollute it. A typical installation utilizes hydraulic pressure to operate the valves, using fail safe type valves that are held open only during the application of high hydraulic pressures to them and which automatically close when the hydraulic pressures are reduced. Hydraulic control lines 84 (FIG. 3) are provided that extend down from the transfer structure parallel to the cargo-carrying conduits at 34, 36 to the seabed. The lines carry hydraulic pressures of up to a few thousand psi. To provide for such high hydraulic pressures, without requiring the transference of such high pressures between the rotating vessel 14 and the stationary turret 46, a motor-pump apparatus 88 is provided on the fixed turret 46 to form a pressured hydraulic fluid source. As also shown in FIG. 4, the motor-pump apparatus 88 includes an air motor 90 which drives a hydraulic pump 92 that delivers pressured hydraulic fluid to an accumulator 94 and to an outlet 96. The outlet 96 is delivered to a control station 98 which includes various controls that can operate hydraulic valves and other devices. The air motor 90 is driven by a power fluid such as compressed air received over a pressured air line 100. The pressure air line 100 is connected through another fluid swivel unit 102 (FIG. 3) that connects to a rotating air line 104 that extends to an air compressor 105 on the vessel 14. Pressured air can be delivered at a moderate pressure such as 200 psi through the swivel unit 102 to the motor-pump set 88 to power it so as to generate hydraulic pressures such as 3000 psi.

The various valves and other remotely controlled devices are normally operated by a person quartered on the vessel 14 who walks across the walkway 54 on the control deck 52 to stand or sit beside the control station 98. However, it is also desirable to provide for operation of at least some critical controls from the vessel 14, to avoid the need for personnel to be stationed on the transfer structure during violent storms. To accomplish this, an electrical control line 106 is provided which carries control currents through a rotating electrical transfer apparatus 108, which may utilize conventional techniques such as a wiper which presses against a rotating conduction ring, to deliver currents through a line 110 to the control station 98 to permit remote operation of certain controls thereof.

While the pressure reducing apparatus is shown utilized for a subsea production and storage terminal wherein the transfer structure can be negatively buoyant by fixing its rotatable frame 30 to the vessel, it is also possible to utilize the pressure reduction apparatus in other systems where the transfer structure is independently buoyant. In the case of an independently buoyant transfer structure for a production and storage terminal, the dedicated vessel can be allowed to pivot about one or more horizontal axes as well as rotate about a vertical axis, relative to the fixed portion of the transfer structure. Accordingly, one or more auxiliary fluid swivels may be required along the fluid conduit extending between the fluid swivel mounted on the transfer structure and the vessel. The use of a choke to reduce the pressure of oil, from a high level such as 2000 psi to a moderate level such as 200 psi, can be of great benefit in simplifying the multiple fluid swivels in such systems.

Thus, the invention provides an offshore terminal installation or system of a type which includes a transfer structure with a substantially stationary portion connected by fluid lines to the sea floor and by rotating fluid lines to a rotating vessel by means of a fluid swivel, which minimizes problems caused by relative rotation of the vessel to the stationary portion of the transfer structure. High pressure fluids received from the sea floor are first reduced in pressure to a moderate level, such as from several thousand p.s.i. to a few hundred psi, before passage through a fluid swivel to the vessel, thereby permitting a less complicated and lower cost fluid swivel to be utilized. High pressure fluid to be pumped down from the transfer structure to the sea floor, such as high pressure hydraulic fluid for control, can be generated on the stationary portion of the transfer structure, and power therefor can be provided by a lower pressured powering fluid such as compressed air that can pass through a moderate pressure fluid swivel. Controls for operating the stationary portions of the installation, can be situated on the stationary portion of the transfer structure, and the controls can lie on a deck with a substantially circular perimeter that permits easy access by personnel quartered on the rotatable vessel.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In an offshore undersea hydrocarbon production terminal installation which includes a transfer structure that lies substantially at the sea surface and is anchored to the sea floor and connected to a floating storage vessel, and a fluid conduit which extends from the sea floor through the transfer structure to the vessel, to carry high pressure fluid from an oil well at the sea floor to the vessel, and wherein the vessel and a portion of the transfer structure must be allowed to rotate without limit about a vertical axis, the improvement wherein:

said transfer structure includes a nonrotatable frame anchored to the sea floor so it cannot rotate without limit about a vertical axis, and a rotatable frame which can rotate without limit about a vertical axis and which is connected to the vessel;

said fluid conduit includes a fluid swivel having a nonrotatable swivel portion substantially fixed to said nonrotatable frame and a rotatable swivel portion, and said fluid conduit also includes a rotating conduit portion connecting the rotatable swivel portion to the vessel; and said fluid conduit also includes a riser conduit portion extending from substantially the sea floor to said transfer structure, and a pressure reducing means mounted on said nonrotatable frame and connected between said riser conduit portion and said nonrotatable fluid swivel portion, for reducing the pressure of fluid that is delivered to the fluid swivel, whereby to enable a moderate pressure fluid swivel to be used to carry initially high pressure fluid from the sea floor to the vessel.

2. The improvement described in claim 1 wherein said terminal includes a second fluid conduit having a second riser portion extending from the sea floor to said transfer structure, to carry fluid at a high pressure that may be different from the pressure in said first mentioned riser conduit portion;

said first riser portion includes a manifold connected between said pressure reducing means and said fluid swivel; and said second fluid conduit includes a second pressure reducing means having an outlet connected to said manifold, whereby to enable passage of high pressure fluid from a plurality of high pressure wells through a single moderate pressure fluid swivel.

3. The improvement described in claim 2 wherein:

said nonrotatable portion of said transfer structure includes upper and lower decks and said pressure reducing means and manifold are located on said lower deck;

said terminal installation includes a plurality of remotely operable valves, and said transfer structure includes a plurality of fluid controls located on said upper deck;

said rotatable frame of said transfer structure is fixed to said vessel; and said vessel has a vessel deck adjacent to said transfer structure, and said transfer structure upper deck has a substantially circular floor located at substantially the same level as the deck.

4. An offshore hydrocarbon production system for storing oil produced by underwater wells, comprising:

a dedicated storage vessel;

a transfer structure having a nonrotatable turret and having a rotatable frame rotatable about a vertical axis on said turret and fixed to said vessel;

means anchoring said turret to the sea bed;

a fluid swivel having a stationary portion mounted to rotate with said turret and a rotatable portion;

a pipe connecting said rotatable portion of said fluid swivel to said vessel;

a fluid conduit extending from an underwater well to said turret; and choke means connected between said fluid conduit and said nonrotatable portion of said fluid swivel, for reducing the pressure of oil in the fluid swivel.

5. The improvement described in claim 4 including:

a multiproduct swivel unit which includes said first mentioned fluid swivel and a second fluid swivel;

an air compressor on said vessel connected to said second fluid swivel to deliver air thereto; and a compressed air-powered pump on said turret connected to said second fluid swivel to receive air therefrom.

6. The system described in claim 4 wherein:

said fluid conduit carries fluid at a pressure of over 1000 psi, while said fluid swivel carries said fluid at a pressure less than half as much.

7. In an offshore hydrocarbon production and storage system wherein hydrocarbons produced at high pressure at a sea floor well are carried along a conduit up to a transfer structure which is located at the sea surface and anchored to the sea floor, and the hydrocarbon must pass through the stationary and rotatable portions of a fluid swivel mounted on the transfer structure to reach a dedicated storage vessel that can rotate about a vertical axis about the transfer structure, the improvement comprising:

a choke connected in series with said conduit between the sea floor and the stationary portion of the fluid swivel, to reduce the pressure of oil flowing through the fluid swivel.

8. The improvement described in claim 7 wherein:

said sea floor well produces oil at a pressure of over a thousand psi, and said choke reduces the pressure to less than half as much.

9. The improvement described in claim 7 wherein said system includes a second sea floor well and a pair of pipes carrying hydrocarbons from each well to said transfer structure, and including:

a second choke connected to a pipe which carries hydrocarbons from said second well, and a manifold having an inlet connected to the outlets of both chokes and an outlet connected to the stationary portion of said fluid swivel.

10. An offshore terminal system disposed over a seabed, comprising:

a storage vessel;

a transfer structure having a nonrotatable frame and having a rotatable frame connected to the vessel;

means for anchoring said nonrotatable frame to the sea bed;

a fluid conduit extending between the sea bed and said nonrotatable frame;

at least one hydraulically controlled valve disposed along said fluid conduit;

a hydraulic control located on said nonrotatable frame and coupled to said valve to operate it;

a fluid-powered hydraulic fluid source located on said nonrotatable frame and coupled to said hydraulic control, to supply pressured hydraulic fluid thereto;

a fluid swivel mounted on said nonrotatable frame and connected to said fluid-powered hydraulic source, to supply power fluid thereto; and a source of pressured power fluid located on said vessel and connected to said fluid swivel to supply power fluid to said hydraulic fluid source, said source of power fluid supplying power fluid at a much lower pressure than the pressure of hydraulic fluid supplied by said hydraulic fluid source, whereby to enable a fluid swivel of moderate pressure capacity to be utilized.

11. The system described in claim 10 wherein:

said source of power fluid supplies pressured air at a pressure which is less than one thousand pounds per square inch, and said hydraulic source supplies hydraulic fluid at a pressure which is a plurality of times higher than said air pressure.

12. An offshore hydrocarbon production system for producing hydrocarbons from wells at a sea bed comprising:

a vessel;

a transfer structure having a nonrotatable frame and a rotatable frame connected to the vessel;

means for anchoring the lower end of said nonrotatable frame to the sea floor;

a plurality of riser fluid conduits coupled to said wells at said seabed and extending to said nonrotatable frame of said transfer structure;

a manifold located on said nonrotatable frame;

a plurality of chokes, each having an input coupled to one of said riser fluid conduits and an outlet connected to said manifold;

a fluid swivel having a nonrotatable swivel portion mounted at the top of said nonrotatable frame and connected to said manifold to receive fluid therefrom, and having a rotatable swivel portion connected to said vessel.

13. The system described in claim 12 wherein:

said rotatable frame is fixed to said vessel; and said nonrotatable frame includes a hollow vertically-extending enclosure extending from under to above the water surface, a lower deck located at the top of said enclosure and of greater diameter than said enclosure, and an upper deck located immediately above said lower deck and having a circular perimeter adjacent to the deck of said vessel, and including means for providing access to said lower deck from said upper deck.

* * * * *